US005975930A

United States Patent [19]

Matsuura et al.

[11] Patent Number: 5,975,930

[45] Date of Patent: Nov. 2, 1999

[54] SLIDE FIT CONNECTOR

[75] Inventors: Toshifumi Matsuura; Toshiaki Okabe, both of Shizuoka-ken, Japan

[73] Assignee: Yazaki Corporation, Tokyo, Japan

[21] Appl. No.: 09/131,288

[22] Filed: Aug. 7, 1998

[30] Foreign Application Priority Data

Aug. 11, 1997 [JP] Japan ..... 9-216718

[51] Int. Cl.[6] ..... H01R 13/52

[52] U.S. Cl. ..... 439/157; 439/160; 439/310

[58] Field of Search ..... 439/157, 160, 439/310

[56] References Cited

U.S. PATENT DOCUMENTS 5,169,327 12/1992 Hatagishi ..... 439/157
5,172,998 12/1992 Hatagishi ..... 439/157
5,435,738 7/1995 Isohata ..... 439/157

FOREIGN PATENT DOCUMENTS 6-79080 11/1994 Japan .

*Primary Examiner*—Paula Bradley
*Assistant Examiner*—Briggitte R. Hammond
*Attorney, Agent, or Firm*—Oblon, Spivak, McClelland, Maier & Neustadt, P.C.

[57] ABSTRACT

A slide member (30) is provided so as to freely slide back and forth in a direction where both connector housings (20 and 40) are fitted/detached into/from each other. When the slide member (30) slides forth, a point section (55) of a lever (50) is engaged with one engagement section (24) and the one connector housing (40) is drawn into the other connector housing (20) so that both the connector housings (20 and 40) are fitted into each other. Whereas when the slide member (30) slides back, a point section (56) of the lever (50) is engaged with the other engagement section (26) of the other connector housing (20) so that both the connector housings (20 and 40) are detached from each other. The other engagement section (26) is formed so as to protruded in a direction where a plurality of terminals (29) provided to the other connector housing (20) are protruded. Namely, a protruded length (L) of the other engagement section (26) becomes longer than a protruded length (H) of the terminals (29).

5 Claims, 5 Drawing Sheets

SLIDE FIT CONNECTOR

BACKGROUND OF THE INVENTION

1. Field of the Invention

The present invention relates to a slide fit connector in which a slide member is slid back and forth in a direction where multiple and female and male connector housings are fitted and detached, and both the connector housings are easily fitted/detached into/from each other by the lever action of a lever which is turned by means of a weak operational power of the slide member.

2. Description of Relevant Art

A lever-type connector is provided with a multiple female connector housing, and a slide groove is formed in a frame supporting section of the female connector housing. A slide axis protruded below one end of a frame-type lever is supported to the slide groove so as to slide freely. Moreover, a pair of male connector housings, which are fitted/detached into/from the female connector housing, are supported into the frame-type lever by means of a supporting axis so as to be turned freely.

When a lever operating section projected above the other end of the lever is operated in an up-and-down direction and the lever is turned about a slide axis, both the connector housings are fitted/detached into/from each other. The similar technique to such a lever-type connector is disclosed in Japanese Utility Model Application Laid-Open No. 6-79080 and the like.

However, in the case where, for example, the male connector housing is fitted into the female connector housing in narrow fitting space where the female connector housing cannot be seen, the conventional lever-type connector has been required skill to gropingly locate and insert the slide axis to be a fulcrum of the lever into the slide groove of the frame supporting section in the female connector housing, and thus the fitting work of both the connector housings has been complicated. Particularly, since the slide axis of the lever slides in the slide groove of the frame supporting section, when plural male terminals, not shown, protruded in the female connector housing are fitted into plural female terminals, not shown, in the male connector housing, pinch easily occurs, and the male terminals are easily deformed due to the pinch. Moreover, since the slide axis and lever operating section are protruded to both the end sides of the lever supporting the male connector housing, the whole connector becomes large.

SUMMARY OF THE INVENTION

Therefore, the present invention has been achieved with such points in view, and it is an object of the present invention to provide a small-sized slide fit connector which can securely prevent deformation of terminals due to pinch when both connector housings are fitted into and detached from each other.

To accomplish the objects of the present invention described above, there is provided a slide fit connector comprising:

first and second connector housings being able to fit each other;

a slide member provided to the first connector housing so as to slide back and forth freely; and a lever having a base end portion, supported by the slide member in a rotatable manner due to reciprocal movement of the first connector housing at the base end portion about a supporting axis, a midway portion of the lever connected with a pressure cone apex portion of the first connector housing, and a point section of the lever being freely engaged with and removed from a first and second engagement sections of the second connector housing when both the connector housings are fitted to and detached from each other;

wherein when the slide member slides forth, the point section of the lever is engaged with the first engagement section of the second connector housing and the first connector housing is drawn to the second connector housing so that both the connector housings are fitted to each other, whereas when the slide member slides back, the point section of the lever is engaged with the second engagement section of the second connector housing so that both the connector housings are detached from each other, and the second engagement section is provided so as to be extended in a direction where a plurality of terminals provided to the second connector housing are projected.

In this slide fit connector, the operation for fitting/detaching both first and second connector housings to/from each other can be performed easily only by performing the sliding operation of the slide member in the direction where both the connector housings are fitted/detached to/from each other. At this time, both the connector housings are fitted/detached to/from each other smoothly and securely by a lever action of the lever obtained by weak operating force of the slide member. Moreover, since the second engagement section which is extended in the direction where the plural terminals are protruded prevents pinch between the terminals of both the connector housings, when both the connector housings are fitted/detached to/from each other, the deformation of the terminals due to pinch can be prevented securely.

In a preferred embodiment, a projected length of the second engagement section is longer than a projected length of the terminals.

In this slide fit connector, since the terminals are not projected to the outside further than the second engagement section, the lever action of the lever is not damaged by the terminals, so both the connector housings are always fitted/detached to/from each other securely in a stable state, and when both the connector housings are fitted/detached to/from each other, pinch does not occur between the terminals of both the connector housings.

In another preferred embodiment, a flat surface and a taper surface are formed on the projected portion of the second engagement section, and when both the connector housings are fitted/detached to/from each other, the point section of the lever is freely brought into contact with the taper surface of the second engagement section.

In this slide fit connector, a length of the lever becomes short, and thus the whole connector is miniaturized. Moreover, since the second engagement section provides the lever action of the lever and also prevents the pinch due to the terminals, it is not necessary to additionally provide a pinch preventing member to the connector housings, so a number of parts is reduced and the cost of the whole connector is further reduced.

BRIEF DESCRIPTION OF THE ACCOMPANYING DRAWINGS

The above and further objects and novel features of the present invention will more fully appear from the following detailed description when the same is read in conjunction with the accompanying drawings, in which.

Figure 4A:
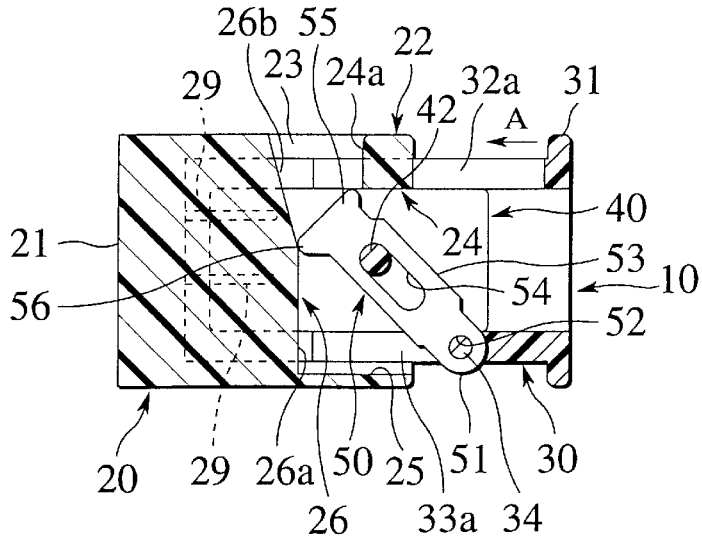
Figure 4B:
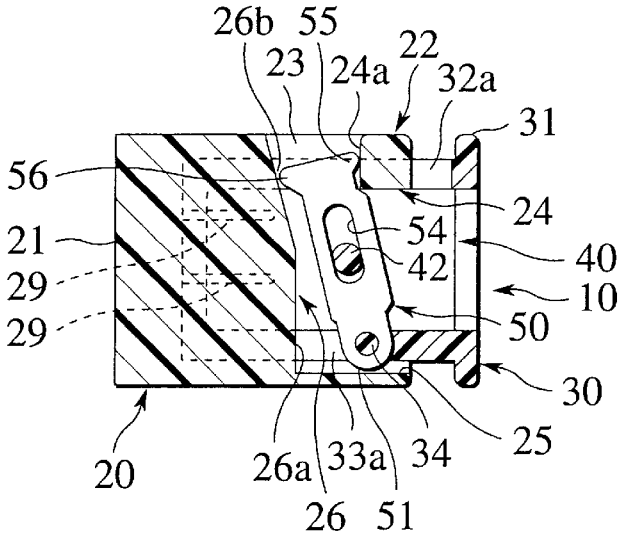
Figure 4C:
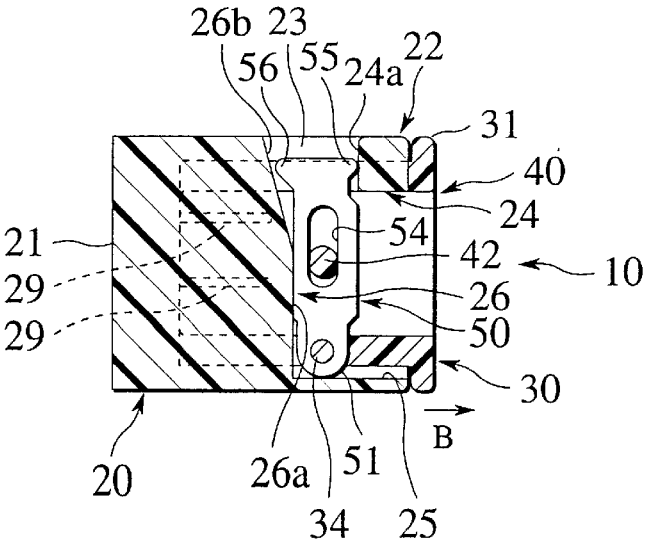
Figure 5A:
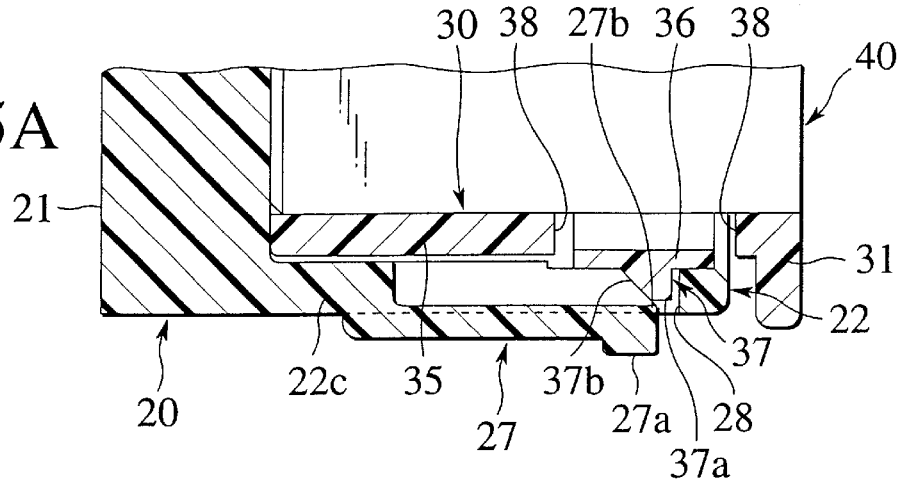
Figure 5B:
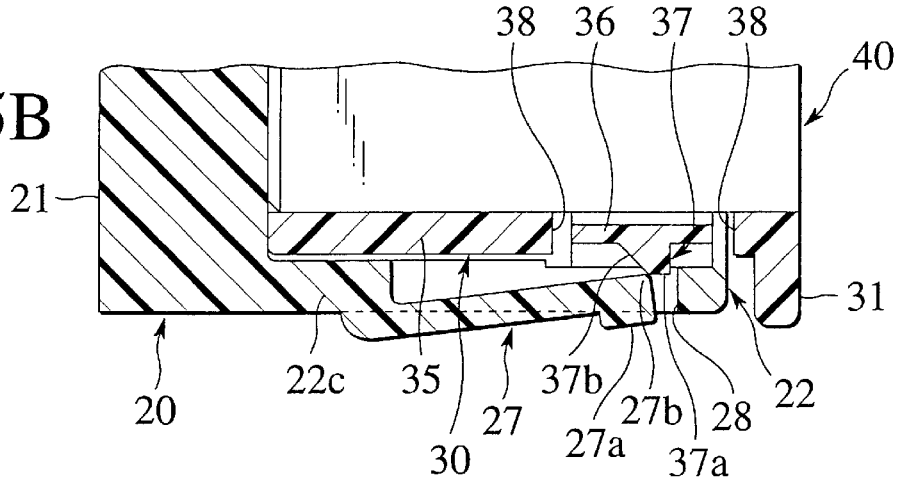
Figure 5C:
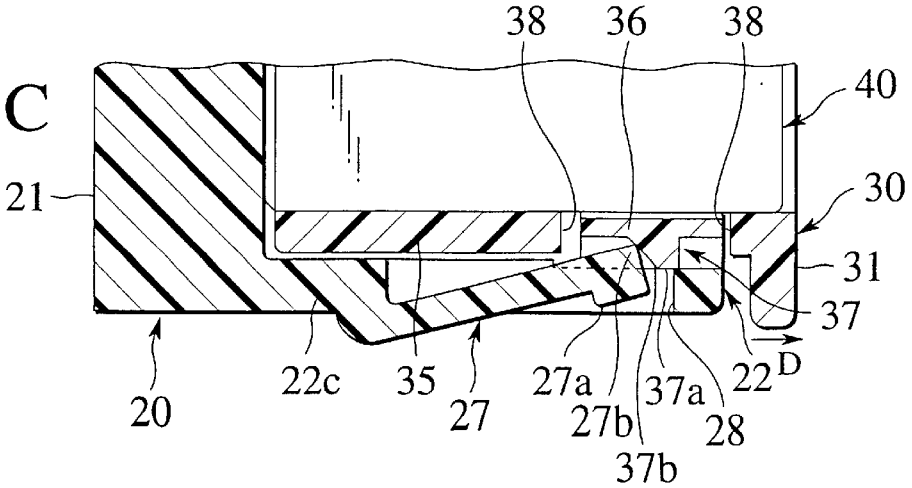

FIG. 4A is a sectional view when fitting of the female and male connector housings is started, FIG. 4B is a sectional view in the middle of the fitting, and FIG. 4C is a sectional view when the fitting is completed; and FIG. 5A is a sectional view showing a locked state when the female and male connector housings of the slide fit connector are fitted to each other, FIG. 5B is a sectional view showing a state in the middle of releasing the lock state, and FIG. 5C is a sectional view showing a state that the lock state is released.

DETAILED DESCRIPTION OF THE PREFERRED EMBODIMENTS

The following describes one embodiment of the present invention on reference to the accompanying drawings.

Figure 1:
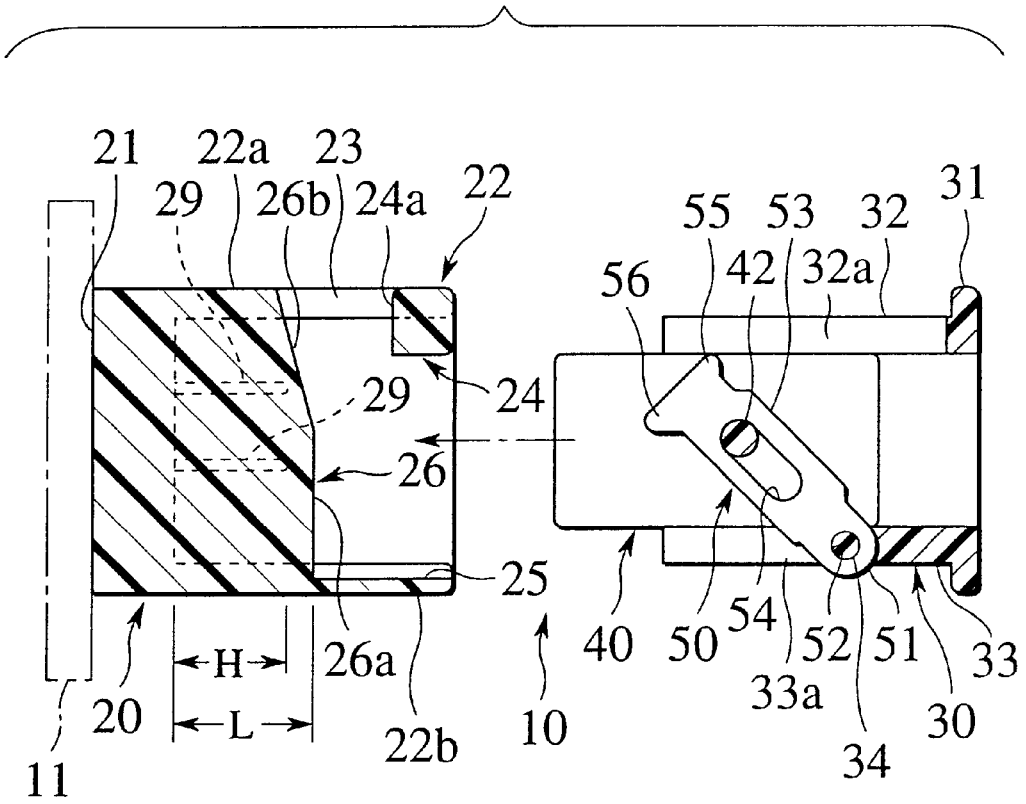
FIG. 1 is a sectional view showing a state before fitting of a slide fit connector according to one embodiment of the present invention.
Figure 2:
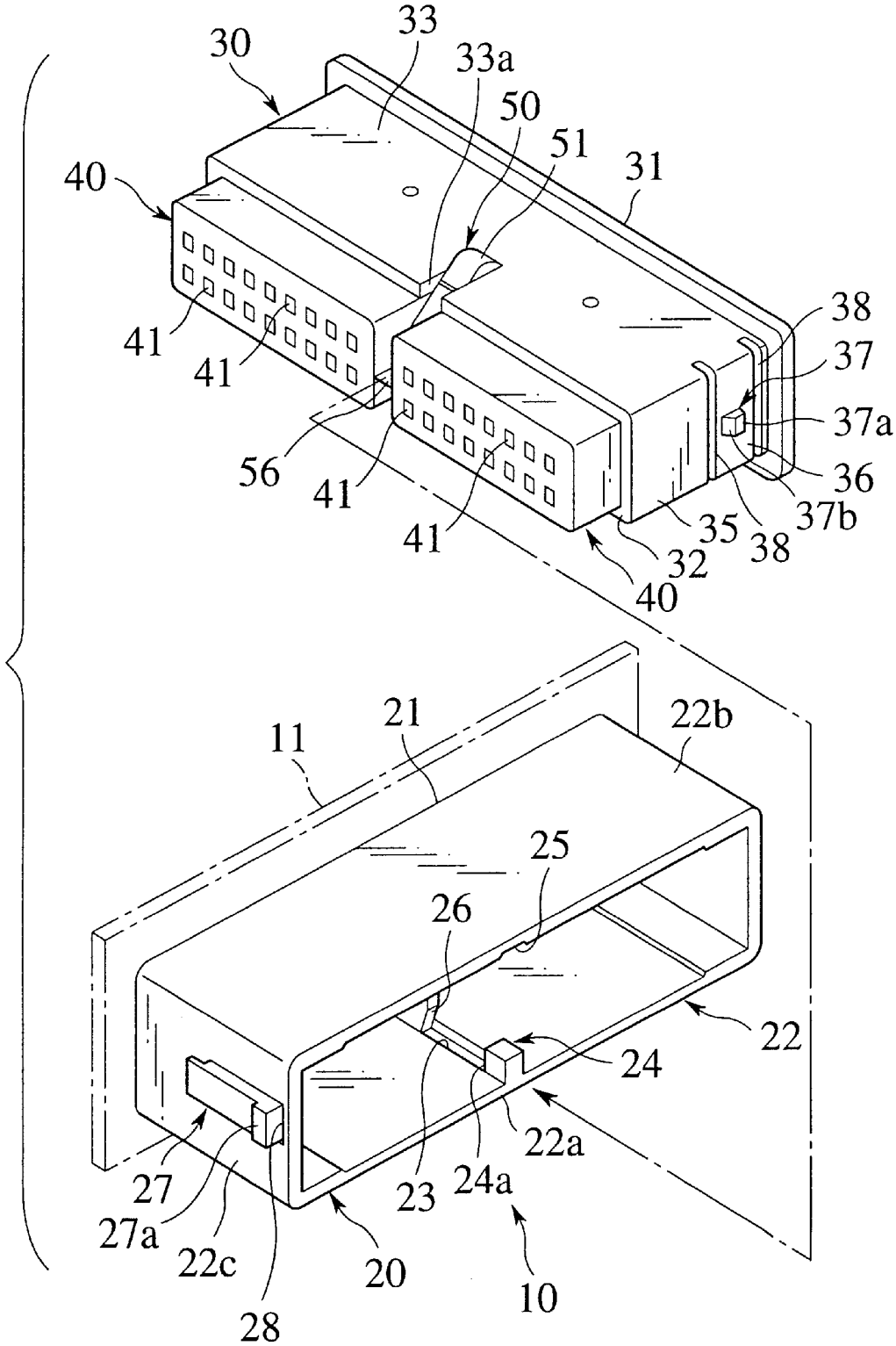
FIG. 2 is a perspective view viewed from a bottom side of a female connector housing and male connector housing before fitting of the slide fit connector.

As shown in FIGS. 1 and 2, in a slide fit connector 10, a plurality of male terminals 29 are protruded from a back wall 21 into a square drum-shaped hood section 22. The slide fit connector 10 is composed of a female connector housing (the other connector housing) 20 made of synthetic resin, in which a rear side of the back wall 21 is fixed to a substrate 11, a square drum-shaped slide cover (slide member) 30 made of synthetic resin, which is fitted into the hood section 22 of the female connector housing 20 so as to have a play and to slide back and forth freely, a pair of rectangular solid shape male connector housings (connector housings on one side) 40 made of synthetic resin, which is supported into the slide cover 30 so as to slide back and forth freely, and a lever 50 made of synthetic resin, which is placed between the pair of male connector housings 40 in the center of the slide cover 30, and is turned by the sliding-back-and-forth of the slide cover 30, and fits/detaches the male connector housings 40 on the movable side into/from the female connector housing 20 on the fixed side by the lever action.

A rectangular opening 23 is formed in the central portion of an upper wall 22*a* of the hood section 22 of the female connector housing 20. A block-shaped projected portion (one engagement portion) 24 is formed integrally on the inner surface of the upper wall 22*a* of the hood section 22 so as to be protruded from a front end of the opening 23. A rear surface of the projected portion 24 and a front end surface of the opening 23 form an engagement surface 24*a*. Moreover, a groove-shaped recess portion (lever guiding section) 25 which links the front end and the back wall 21 is formed in the center of the inner surface of a lower wall 22*b* of the hood section 22 of the female connector housing 20. A rib (the other engagement section) 26 is formed integrally in the center of the inner surface of the back wall 21 facing the opening 23 so as to protruded from the backward end of the recess section 25. A flat surface 26*a* is formed from the side of the recess section 25 to the central portion of the protruded portion of the rib 26, and a taper surface (slanted surface) 26*b* is formed from the central portion to the opening 23.

Moreover, as shown in FIGS. 1, 4A, 4B and 4C, the rib 26 is formed integrally in the center of the back wall 21 so as to extended parallel with the direction where the plural male terminals 29 are protruded in the hood section 22 from the back wall 21 of the female connector housing 20. Namely, the rib 26 is formed in the hood section 22 integrally so as to protruded from the back wall 21 so that a protruded length L of the rib 26 becomes longer than a protruded length H of the male terminals 29. As a result, the points of the male terminals 29 are not protruded to the outer side farther than the flat surface 26*a* and taper surface 26*b* of the rib 26 (the side of the opening of the hood section 22), and thus the rib 26 has a function to push out the lever 50 (lever action) as well as a function to prevent deformation of the male terminals 29 due to pinch.

Furthermore, as shown in FIGS. 2, 5A, 5B and 5C, an approximately L-shaped flexible releasing arm (releasing member) 27 is formed integrally so as to protruded from the center of a side wall 22*c* of the hood section 22 of the female connector housing 20. A circumference of the base of the releasing arm 27 other than the jointed portion with the wall 22*c* is an engagement hole (engagement section) 28 which is notched into U shape. When a pressing section 27*a* on a front outer surface of the releasing arm 27 is pressed, a front end angular portion (releasing portion) 27*b* on the inner front surface of the releasing arm 27 is protruded inward (to the side of the engagement hole 28).

Figure 3:
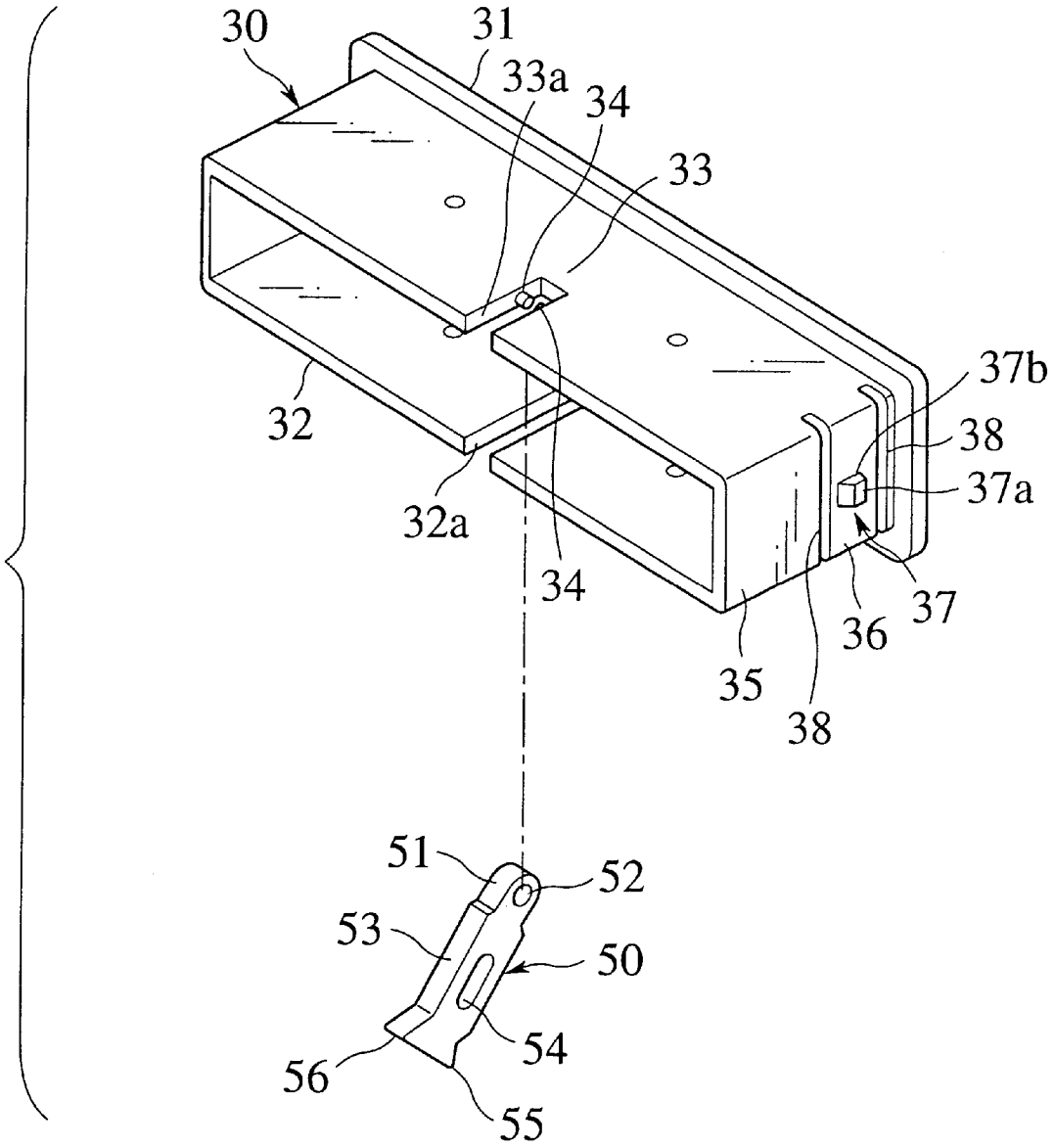
FIG. 3 is a perspective view viewed from a bottom side of a slide cover which covers the male connector housing and a lever which is supported to the slide cover so as to be moved freely.

As shown in FIGS. 2 and 3, the slide cover 30 is formed by synthetic resin so as to have a square drum shape. The slide cover 30 covers the male connector housings 40 so as to slide freely, and when the connector housings 20 and 40 are fitted/detached into/from each other, the cover 30 slides freely in the hood section 22 of the female connector housing 20. A ring collar-shaped operating section 31 is formed so as to protruded from a front end side of the outer circumferential surface of the square drum-shaped slide cover 30 integrally. Further, long and short slits 32*a* and 33*a* are formed respectively in positions on the center of upper and lower walls 32 and 33 of the slide cover 30 which face each other, and a pair of supporting axes 34, which support a base end portion 51 of the lever 50 so as to turn it freely, are formed integrally on the inner surfaces of the lower short slits (slits on one side) 33*a* which face each other, and the point of the lever 50 is freely inserted/removed into/from the upper long slits (slits on the other side) 32*a*.

Furthermore, a flexible arm (flexible member) 36 is formed integrally on the central front side of one side wall 35 of the slide cover 30. Namely, the flexible arm 36 is integrally formed with thin thickness between a pair of notched portions 38 formed parallel with the front side of the side wall 35 of the slide cover 30, and they are elastically deformed inward. Moreover, a locking section 37 having a trapezoidal section is formed integrally in the center of the flexible arm 36. As shown in FIG. 5A, a taper surface 37*b* is formed on the locking section 37 on the side of the female connector housing 20, a flat surface 37*a* of the locking section 37 is normally brought into or closed to an front end angular portion 27*b* of the releasing arm 27, and the fitting state of the connector housings 20 and 40 is locked by locking between the locking portion 37 of the flexible arm 36 and the engagement hole 28 on the side of the releasing arm 27. Moreover, when the pressing section 27*a* of the releasing arm 27 is pressed, the flat surface 37*a* of the locking portion 37 is pushed against the front end angular portion 27*b* of the releasing arm 27 and the flexible arm 36 is deflected inward so that the front angular portion 27*b* of the releasing arm 27 is brought into contact with the taper surface 37*b* of the locking section 37. As a result, the locking state between the locking section 37 of the flexible arm 36 and the engagement hole 28 on the side of the releasing arm 27 is released, and the slide cover 30 is slightly projected outward with respect to the female connector housing 20 and male connector housings 40 so that the slide cover 30 is easily drawn out.

As shown in FIG. 2, the male connector housing 40 is formed by synthetic resin so as to have an approximately rectangular solid shape, and a plurality of terminal storage chambers 41 are formed between the front and rear surfaces of the male connector housing 40. The terminal storage chambers 41 store female terminals, not shown, which are electrically connected with the male terminals 29 of the female connector housing 20 when the connector housings 20 and 40 are fitted into each other so that the connector housings 20 and 40 are electrically conductive. The female terminals are connected respectively with wire harnesses, not shown. Moreover, the lever 50 is laid between a pair of the male connector housings 40. Namely, a cylindrical supporting pin (pressure cone apex portion) 42, which is a pressure cone apex of the lever 50, is formed integrally or pressed into the front sides of the centers on the side surfaces of the male connector housings 40 facing each other so as to be protruded therefrom.

The lever 50 is formed by synthetic resin into an approximately rectangular board shape, and a round hole 52 is formed in the center of the arc-shaped base end portion 51 of the lever 50. When a pair of supporting axes 34 of the lower short slit 33*a* of the slide cover 30 are fitted into the round hole 52, the base end portion 51 of the lever 50 is supported at its center so as to be turned freely. Moreover, a slot (pressure cone apex receiving portion) 54 is formed in a midway portion 53 of the lever 50, and the slot 54 is engaged with the supporting pins 42 of the male connector housing 40 so as to slide freely. Further, the point of the lever 50 has a pair of point sections 55 and 56 having an approximately rectangular board shape protruded in the front-and-rear direction, and the point section (one point section) 55 on the front side is freely engaged/removed with/from the projected portion 24 as one engagement portion of the female connector housing 20, and the point section (the other point section) 56 on the rear side is freely engaged/removed with/from the rib 26 as the other engagement section of the male connector housing 20. Further, a distance between the base end portion 51 of the lever 50 and the midway portion 53 which is supported (connected) to the supporting pin 42 of the male connector housing 40 becomes longer than a distance between the midway portion 53 and the point sections 55 and 56.

According to the slide fit connector 10 in the aforementioned embodiment, before the female connector housing 20 and the male connector housings 40 shown in FIGS. 1 and 2 are fitted into each other (in the separated state), the lever 50 is slanted between the supporting axis 34 of the slide cover 30 and the supporting pin 42 of the male connector housings 40. As shown in FIG. 4A, after the point of the slide cover 30 covering the male connector housings 40 is inserted and temporarily fitted into the hood section 22 of the female connector housing 20 on the fixed side, when the slide cover 30 is pressed in the direction where the connector housings 20 and 40 are fitted (the moving-forth direction represented by arrow A in FIG. 4A) and is inserted into the hood section 22, the point section 56 on the rear side of the lever 50 is brought into contact with the flat surface 26*a* and then the taper surface 26*b* of the rib 26 in the hood section 22 of the female connector housing 20. As a result, only the lever 50 is turned by the initial moving-forth of the slide cover 30 so that the point section 55 on the front side of the lever 50 is projected upward in the opening 23 of the female connector housing 20, and as shown in FIG. 4B, the point section 55 on the front side of the lever 50 is brought into contact with the engagement surface 24*a* of the projected portion 24 so that the fulcrum is formed.

In this state, as shown in FIG. 4C, when the slide cover 50 is further pressed so as to be inserted in the fitting direction, the male connector housings 40 are drawn into the hood section 22 of the female connector housing 20 by the lever action of the lever 50 (where the round hole 52 of the base end portion 51 of the lever 50 is force point, the supporting pin 42 of the male connector housing 40 is pressure cone apex, and the point section 55 on the front side of the lever 50 is fulcrum), and thus the connector housings 20 and 40 are fitted into each other. At this time, as shown in FIG. 5A, the locking section 37 of the slide cover 30 is locked to the engagement hole 28 of the female connector housing 20 so that the fitting state of the connector housings 20 and 40 is locked. The base end portion 51 of the lever 50 is guided to the recess section 25 of the female connector housing 20 until the locking section 37 of the slide cover 30 is locked to the engagement hole 28 of the female connector housing 20 so that the slide cover 50 slides smoothly.

In the case where the locking of the fitting state is released, as shown in FIG. 5SB, the pressing section 27*a* of the releasing arm 27 of the female connector housing 20 is pressed so that the flat surface 37*a* of the locking section 37 of the slide cover 30 is pushed by the front end angular section 27*b* of the releasing arm 27. As a result, the flexible arm 36 of the slide cover 30 is deflected inward so that the front angular section 27*b* of the releasing arm 27 is brought into contact with the taper surface 37*b* of the locking section 37. For this reason, as shown in FIG. 5C, the locked state between the locking section 37 of the flexible arm 36 and the engagement hole 28 on the side of the releasing arm 27 is released, and simultaneously the slide cover 30 is pushed out slightly to the outside of the female connector housing 20 and male connector housings 40 (the direction represented by arrow D in FIG. 5C) so that the slide cover 30 is easily pulled out. As a result, in the case where the connector housings 20 and 40 are removed from each other, when the slide cover 30 is pulled out in the moving-back direction (direction represented by arrow B in FIG. 4C), the point section 56 on the rear side of the lever 50, which is brought into contact with the taper surface 26*b* of the rib 26, is a fulcrum, and as the slide cover 30 is pulled out, the connector housings 20 and 40 are removed from each other by the lever action of the lever 50 (where the round hole 52 of the base end portion 51 of the lever 50 is force point, the supporting pin 42 of the male connector housing 40 is pressure cone apex, and the point section 56 on the rear side of the lever 50 is fulcrum).

In such a manner, the slide cover 30 is provided so as to freely slide back and forth in the direction where the connector housings are fitted/detached into/from each other, and when the slide cover 30 moves forth, the point section 55 on the front side of the lever 50 is brought into contact with the engagement surface 24*a* of the projected portion 24 of the female connector housing 20, and thus the male connector housings 40 are drawn into the female connector housing 20 so that the connector housings 20 and 40 are fitted into each other. Moreover, at the same time the point section 56 on the rear side of the lever 50 of the slide cover 30 is brought into contact with the taper surface 26*b* of the rib 26 of the female connector housing 20 when the slide cover 30 moves back so that the connector housings 20 and 40 are detached from each other. As a result, when only the slide cover 30 is slid by a weak operating force in the fitting/detaching direction, the fitting/detaching operation of the connector housings 20 and 40 can be performed easily. Particularly, when the connector housings 20 and 40 are fitted into each other, the fitting operation can be performed only by pressing the slide cover 30 in the fitting direction, so, for example, even in the work in a narrow fitting space where the female connector housing 20 on the fixed side cannot be seen, the connector housings 20 and 40 can be fitted into each other smoothly for a short time without requiring skill.

When the connector housings 20 and 40 are fitted/detached into/from each other, the points of the male terminals 29 are not projected to the side of the opening of the hood section 22 with them exceeding the flat surface 26*a* and taper surface 26*b* of the rib 26, so the lever action of the lever 50 is not damaged by the male terminals 29, and thus the connector housings 20 and 40 can be always fitted/detached into/from each other easily and securely in the stable state. Namely, the male connector housings 40 can be smoothly moved back and forth parallel with the female connector housing 20 by the rib 26 and lever 50, and when the connector housings 20 and 40 are fitted/detached into/from each other, pinch does not occur between the male terminals 29 and the female terminals, not shown, on the other side. As mentioned above, since the rib 26 pushes out the lever 50 and also prevents the male terminals 29 from being deformed due to pinch, when the connector housings 20 and 40 are fitted/detached into/from each other, the deformation of the male terminals 29 due to pinch can be prevented securely and the length of the lever 50 can be reduced as short as possible. As a result, the whole connector can be miniaturized. Further, since the rib 26 pushes out the lever 50 and also prevents pinch of the terminals, it is not necessary to additionally provide a pinch preventing member to the side of the female connector housing 20. As a result, a number of parts can be reduced and the cost of the whole connector can be further reduced.

According to the aforementioned embodiment, only one lever is provided in the center of the slide cover, but two or more levers may be provided. Moreover, the lever is provided to the side of the male connector housing, but it may be provided to the side of the female connector housing.

What is claimed is:

1. A slide fit connector comprising:

first and second connector housings being able to fit to each other;

a slide member provided to said first connector housing so as to slide back and forth freely; and a lever having a base end portion, supported by said slide member in a rotatable manner due to back and forth movement of said first connector housing at the base end portion about a supporting axis, a midway portion of said lever connected with a pressure cone apex portion of said first connector housing, and a point section of said lever being freely engaged with and removed from a first and second engagement sections of said second connector housing when both said connector housings are fitted to and detached from each other;

wherein when said slide member slides forth to said second connector housing, the point section of said lever is engaged with said first engagement section of said second connector housing and said first connector housing is drawn to said second connector housing so that both said connector housings are fitted to each other, whereas when said slide member slides back from said second connector housing, the point section of said lever is engaged with said second engagement section of said second connector housing so that both said connector housings are detached from each other, and said second engagement section is provided so as to be extended in a direction where a plurality of terminals provided to said second connector housing are projected.

2. A slide fit connector according to claim 1, wherein a flat surface and a taper surface are formed on the projected portion of said second engagement section, and when both said connector housings are fitted to and detached from each other, the point section of said lever is freely brought into contact with the taper surface of said second engagement section.

3. A slide fit connector according to claim 1, wherein said first connector housing fits into said second connector housing.

4. A slide fit connector according to claim 1, wherein a projected length of said second engagement section is longer than a projected length of the terminals.

5. A slide fit connector according to claim 2, wherein a flat surface and a taper surface are formed on the projected portion of said second engagement section, and when both said connector housings are fitted to and detached from each other, the point section of said lever is freely brought into contact with the taper surface of said second engagement section.

* * * * *